United States Patent [19]

Grothaus

[11] Patent Number: 4,558,788

[45] Date of Patent: Dec. 17, 1985

[54] EYEGLASS DISPLAY APPARATUS

[76] Inventor: John F. Grothaus, 2584 Patterson Rd., Pataskala, Ohio 43062

[21] Appl. No.: 626,493

[22] Filed: Jun. 29, 1984

[51] Int. Cl.[4] ..... A47F 7/00

[52] U.S. Cl. ..... 211/13; 248/DIG. 2

[58] Field of Search ..... 211/13; D16/129; D6/418, 467, 512, 553; 248/DIG. 2

[56] References Cited

U.S. PATENT DOCUMENTS

| | | |
|---|---|---|
| D. 113,402 | 2/1939 | Schram . |
| D. 154,472 | 7/1949 | Giuliana . |
| 176,779 | 5/1876 | Ebert . |
| 993,404 | 5/1911 | Price . |
| 1,219,685 | 3/1917 | Wall . |
| 1,710,847 | 4/1929 | Thursby . |
| 2,049,684 | 8/1936 | Bongiovanni et al. . |
| 2,623,722 | 12/1952 | Glunt et al. . |
| 2,713,947 | 7/1955 | Foster . |
| 2,966,271 | 12/1960 | Nadel . |
| 3,229,944 | 1/1966 | Everburg . |
| 3,322,381 | 5/1967 | Bubb . |
| 3,519,133 | 7/1970 | Murray . |
| 3,797,792 | 3/1974 | Huber . |
| 3,955,681 | 5/1976 | DeZinno . |
| 4,204,602 | 5/1980 | Dunchock . |

FOREIGN PATENT DOCUMENTS 2742849 4/1979 Fed. Rep. of Germany ... 248/DIG.

*Primary Examiner*—Ramon S. Britts
*Assistant Examiner*—Sarah A. Lechok Eley
*Attorney, Agent, or Firm*—Biebel, French & Nauman

[57] ABSTRACT

Eyeglasses are displayed in a simulated in-use position along one or more generally vertical support posts by means of display clips which are frictionally engaged to the support posts at selected locations and selected radial orientations relative to the posts. The display clips each comprise a post engaging section defining a first channel for conformably engaging a support post with the first channel being open and flared to resiliently receive a support post. Second and third horizontal channels are integrally formed to the central post engaging section and extend therefrom on opposite sides of the first channel to receive the lower edges of eyepiece rims of a pair of eyeglasses, the temples of which stradle and extend beyond the associated support post such that a bridge portion of the eyeglasses rests against the support post to maintain the eyeglasses in a display posture with one or both of the temples fully extended and, hence, clearly in view.

12 Claims, 5 Drawing Figures

EYEGLASS DISPLAY APPARATUS

BACKGROUND OF THE INVENTION

This invention relates generally to merchandising display apparatus and, more particularly, to display apparatus for attractively supporting eyeglasses or eyeglass frames hereinafter often generically referred to as eyeglasses.

Eyeglasses have been displayed for sale in a large variety of display devices. Oftentimes, the eyeglasses are displayed in a folded configuration supported on a narrow tray sized to receive the folded frames. While this type of display is quite common, eyeglasses thus displayed are difficult to evaluate since they are not in the normal "in-use" configuration with the temples extended and hence must be removed and opened to be fully viewed and evaluated.

Sunglasses are frequently displayed on cards which completely conceal the temples and further prevent convenient evaluation of the overall appearance of the eyeglasses. To more fully display the eyeglasses, stands are available which support the eyeglasses in an extended, in-use position as illustrated, for example, in Foster, U.S. Pat. No. 2,713,947.

A display fixture is disclosed in Everburg, U.S. Pat. No. 3,229,944, which also permits eyeglasses to be exhibited in a simulated position of use. In Everburg, an eyeglass support tray is angularly oriented relative to a rear mounting plate by means of a supporting bracket which is interconnected to the plate by means of lugs which extend through the plate and are secured thereto by retaining clips behind the plate.

While the Foster and Everburg displays improve over simple trays wherein the eyeglasses must be supported in a folded condition, these displays are of a relatively fixed nature such that the display cannot be easily rearranged or are not completely stable and may tend to be inadvertently upset or overturned by persons viewing the eyeglasses displayed thereon.

It is, thus, apparent that the need exists for an improved eyeglass display for attractively supporting eyeglasses in a simulated in-use position which provides stable support for the eyeglasses, is inexpensive and easy to assemble, and permits versatility in the arrangement and configuration of the display.

SUMMARY OF THE INVENTION

In accordance with the present invention, eyeglass display apparatus provides stable support for eyeglasses in a simulated in-use position along a generally vertical support post by means of display clips which are frictionally engaged to the support post at selected locations and selected radial orientations relative to the post. The display clips each comprise a central post engaging section including a generally vertically oriented first channel for conformably engaging a support post with the first channel being open on one side such that it may be spread apart to resiliently receive the post. Second and third generally horizontal channels are integrally formed to the central post engaging section and extend therefrom on opposite sides of the opening of the first channel. The second and third channels are open in an upward direction when the clip is engaged with the support post.

In accordance with the present invention, eyeglasses are supported for attractive and complete visual display by inserting the lower edges of the lenses or eyepiece rims of a pair of eyeglasses into the second and third channels, with the temples straddling and extending beyond the associated support post such that a bridge portion of the eyeglasses rests against the support post to maintain the eyeglasses in an attractive display posture with one or both of the temples fully extended and, hence, clearly in view.

Preferably, the first channel and support post are formed to permit the display clips to be positioned into a plurality of angular positions relative to the support posts such that the eyeglasses supported on the clips may be displayed in any one of the plurality of positions. An unlimited number of such radial positions are provided when the first channel and support post are made circular in cross-section. The opening of the first channel is preferably flared to facilitate engagement of the first channel with the support post.

While a single support post and associated eyeglass display clips can be utilized to prepare an eyeglass display, preferably a plurality of generally vertically oriented support posts are provided. A plurality of eyeglass display clips are frictionally engaged to each of the support posts for supporting a like plurality of eyeglasses.

The support posts and the first channels of the eyeglass display clips are formed to permit the clips to be positioned at a plurality of angular orientations relative to the support posts such that the displayed eyeglasses may be arranged in a large variety of patterns. For example, eyeglasses may be oriented such that the extended temples form a spiralling pattern as one progresses from the bottom to the top of the support post. Alternately, eyeglasses on adjacent posts may be positioned to face one another directly or at a desired angle relative to one another and, of course, the clips may be positioned at any location along the post such that eyeglasses displayed on adjacent posts may be at different levels. The clips may also be removed as eyeglasses are sold such that the display can be reviewed to perform a visual inventory of eyeglasses in stock.

It is, thus, an object of the present invention to provide an improved merchandising display for supporting eyeglasses which is inexpensive, easy to assemble and permits versatility in the arrangement and configuration of the display.

It is another object of the present invention to provide an improved merchandising display for supporting eyeglasses in a simulated in-use position which permits a complete view of the eyeglasses with little distraction from the supporting apparatus to thereby minimize the need for handling the eyeglasses during evaluation.

It is yet another object of the present invention to provide an improved merchandising display for supporting eyeglasses in a simulated in-use position by means of eyeglass display clips which frictionally engage a generally verticaly support post and include horizontal channels for receiving the lower edges of the rims of a pair of eyeglasses such that the temples are extended on either side of the post and the bridge portion interconnecting the eyeglass rims rests against the support post.

Other objects and advantages of the invention will be apparent from the following description, the accompanying drawings and the appended claims.

BRIEF DESCRIPTION OF THE DRAWINGS

FIGS. 2A–4 show the front, plan and end view, respectively, of an illustrative eyeglass support clip in accordance with the present invention.

DETAILED DESCRIPTION OF THE INVENTION

Figure 1:
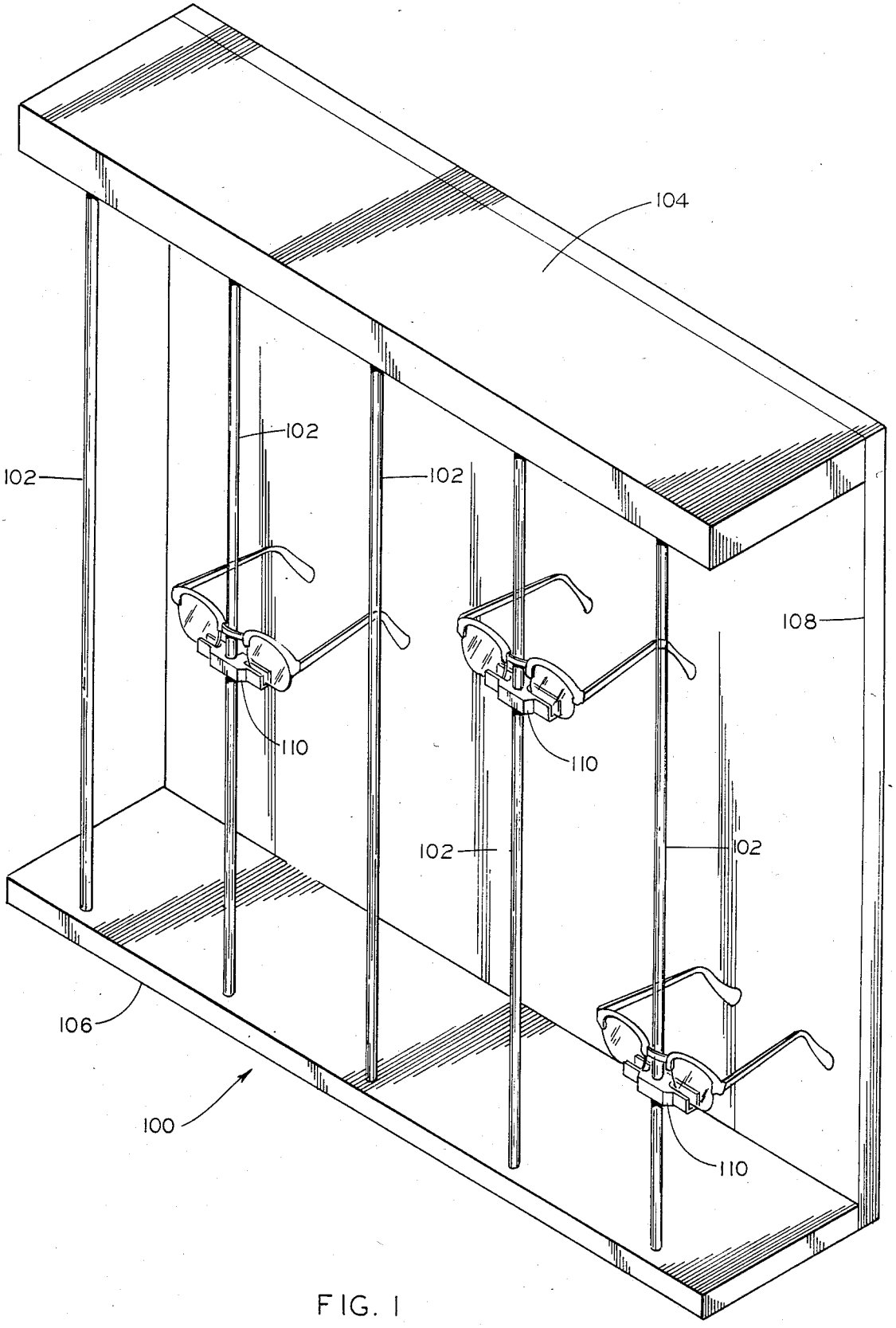
FIG. 1 is a perspective view of a merchandising display in accordance with the present invention for supporting eyeglasses.
Figure 3:
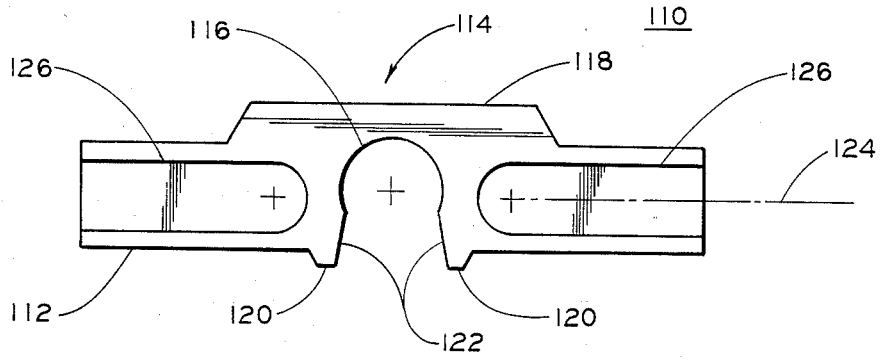
Figure 2:
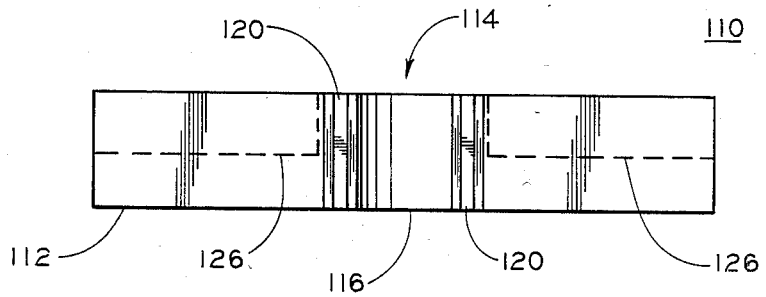
Figure 4:
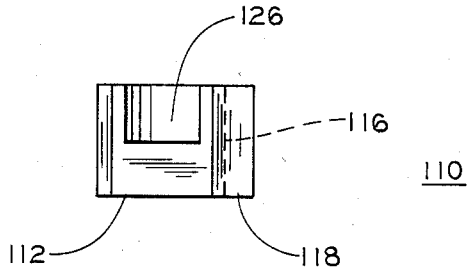

FIG. 1 shows an illustrative embodiment of an eyeglass display unit incorporating the present invention. This unit is shown for ease of illustration and description and it will be appreciated that the number of configurations for display units incorporating the present invention is essentially unlimited since the potential configurations for the display units comprise all possible arrangements of differing numbers of support posts. For example, a series of support posts could be formed into a circle, ellipse or other curvilinear configuration. And, although the support posts must be generally vertical in orientation, the support posts can be inclined and, hence, three dimensional displays simulating planes which are flexed out of the vertical orientation can be constructed to effect quite striking displays.

In FIG. 1, a display unit 100 comprises a plurality of vertical support posts 102 which are supported in a generally vertical orientation between an upper support member 104 and a lower support member 106. The upper support member 104 and lower support member 106 are interconnected by a backing plate 108. Glasses are supported along the support posts 102 by means of eyeglass display clips 110 which conformally engage the support posts 102.

An illustrative embodiment of an eyeglass display clip in accordance with the present invention is shown in more detail in FIGS. 2–5. The illustrated eyeglass display clip comprises a generally rectangular block 112 having a central post engaging section 114 into which is formed a first channel 116 for conformally engaging a selected one of the support posts 102. The first channel 116 is open to the front of the display clip for resiliently receiving a support post 102.

Figure 5:
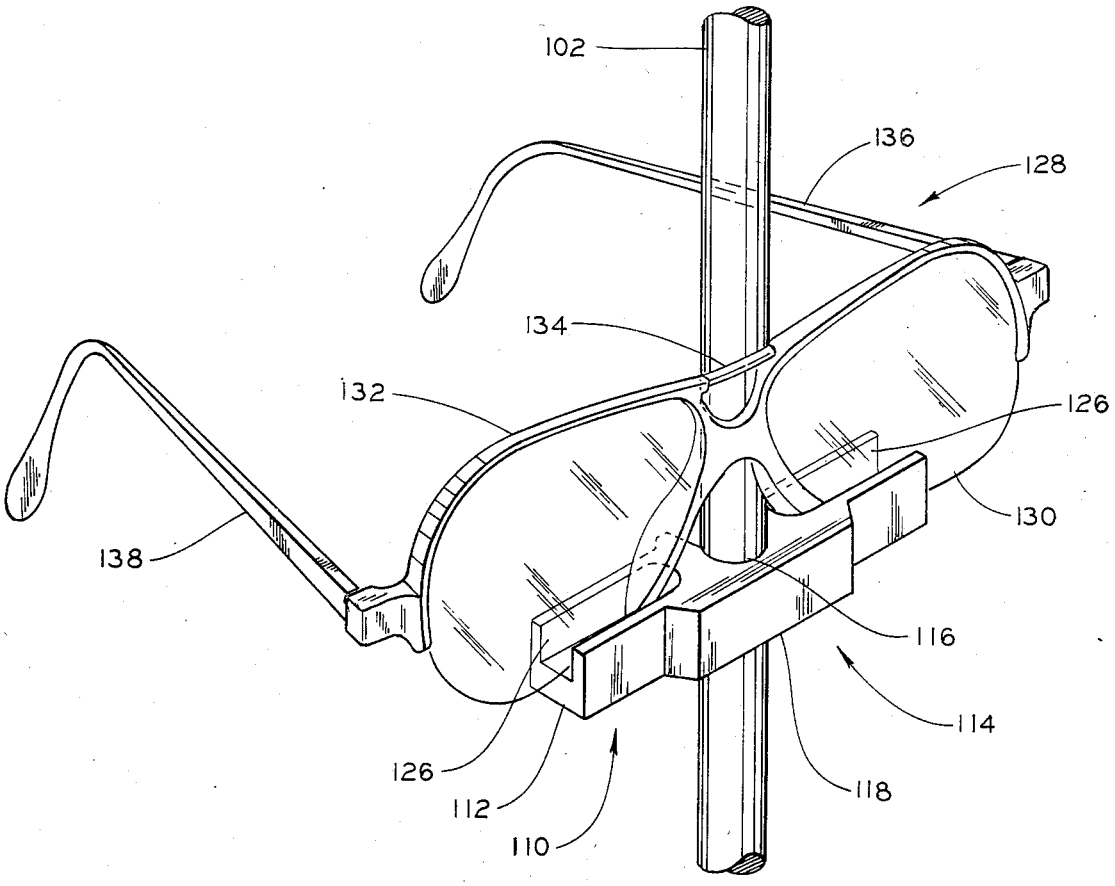
FIG. 5 is a perspective view of a pair of eyeglasses supported in accordance with the present invention.

The central post engaging section 114 is expanded to reinforce the display clip by means of a rib 118 which extends across the rear of the display clip 110. When in use, the flat face of the rib 118 faces one viewing the display, as shown in FIGS. 1 and 5, and can therefore advantageously be used to display price, style or other information regarding the displayed eyeglasses. The central post engaging section 114 also includes two small extensions 120 out the front of the display clip 110. The extensions 120 define angled inner faces 122 which serve to flare the opening to the first channel 116 to facilitate resilient engagement of the channel 116 with a support post 102.

The first channel 116 and associated support posts 102 of the illustrated display clip are circular in cross-section such that the display clips 110 can be positioned at any angular orientation relative to the support posts 102, i.e, the axis 124 of a support clip 110 can be positioned at any point throughout the 360° radial extent of the support post 102. This provides versatility in the eyeglass display since the eyeglasses can be displayed with the temples pointing effectively in any direction.

The only limitation of the orientation of the illustrative display clip is in the event that a support post 102 is inclined rather than being generally vertical, as shown in FIG. 1. In the event a support post is inclined or angularly oriented, the clip must be positioned such that the eyeglasses are supported by the clip and the post as will become apparent.

Of course, other channel and support post cross-sections can be used in the present invention. For example, an octagonal channel and support post cross-section would permit eight different radial orientations of the clips on the posts.

Second and third horizontal channels 126 are integrally formed to the central post engaging section or formed into the upper surface of the generally rectangular block 112 forming the display clip 110. The generally horizontal channels 126 extend from either side of the first channel 116 to the ends of the block 112 where the channels 126 are open to accommodate varying sizes of eyeglasses.

The support of an individual pair of eyeglasses 128 in accordance with the present invention is shown in FIG. 5 where a clip 110 is shown engaged to a support post 102. The eyeglasses 128 have two lens supporting or eyepiece rims 130 and 132 which are interconnected by a central bridge 134 and include a first temple 136 and a second temple 138 hingedly connected to the eyepiece rims 130 and 132, respectively.

The eyeglasses 128 to be supported by the display clip 110 have one or preferably both of the temples 136 and 138 extended as shown in FIG. 5. The eyeglasses 128 are displayed by inserting the lower edges of the lenses or eyepiece rims 130 and 132 into the horizontal channels 126 with the temples 136 and 138 straddling and extending beyond the support post 102 such that the bridge 134 of the eyeglasses engages and rests against the support post 102 to maintain the eyeglasses 128 in an attractive display posture.

With the bridge 134 urged in one direction against the support post 102 and the lower edges of the rims 130 and 132 urged in the opposite direction against the forward edges of the horizontal channels 126 together with the weight of the eyeglasses which tends to seat the lower edges of the rims 130 and 132 in the horizontal channels 126, the eyeglasses 128 are securely held in the eyeglass display clip 110. Thus, eyeglass display apparatus in accordance with the present invention stabily supports eyeglasses without clamps, clips or any other fastening arrangement such that the eyeglasses can be readily removed from and replaced in the display.

As shown in FIG. 5, the eyeglasses 128 are displayed in full view with at least one of the temples 136 and 138 being fully extended to show a simulated in-use position of the eyeglasses 128 for an appealing appearance and proper evaluation of the eyeglasses. While the supporting posts 102 and eyeglass display clips 110 can be constructed of any appropriate material, it is preferred that they be constructed of a highly transparent or clear plastic material such that the eyeglass display apparatus tends to disappear and the eyeglasses appear as floating in the display.

While the form of apparatus herein described constitutes a preferred embodiment of the this invention, it is to be understood that the invention is not limited to this precise form of apparatus and that changes may be made therein without departing from the scope of the invention which is defined in the appended claims.

What is claimed is:

1. An eyeglass display clip for supporting eyeglasses having two eyepiece rims interconnected by a central bridge and including temples hingedly connected to said rims on a generally vertical support post, said display clip comprising:

a post engaging body section of resilient synthetic plastic material including a first channel for conformally engaging said support post, said first channel being open on one side for resiliently receiving said post; and second and third channels integrally formed to said post engaging section and extending therefrom on opposite sides of the opening of said first channel, said second and third channels being substantially aligned with the center of the post engaging portion of said first channel and open in an upward direction when said clip is engaged with said support post whereby eyeglasses are supported for attractive and complete visual display by inserting the lower edges of the eyepiece rims into said second and third channels with said temples extending beyond and on either side of said support post such that the bridge of the eyeglasses rests against said support post to maintain the eyeglasses in an attractive simulated in-use display posture with one or both temples fully extended and, hence, clearly in view.

2. An eyeglass display clip as claimed in claim 1 wherein said first channel and support post are formed to permit said display clip to be positioned into a plurality of angular positions on said support post whereby eyeglasses supported on said clip may be displayed in any one of said plurality of positions.

3. An eyeglass display clip as claimed in claim 2 wherein said first channel and said support post are circular in cross-section.

4. An eyeglass display clip as claimed in claim 3 wherein the opening of said first channel is flared to facilitate engagement with said support post.

5. An eyeglass display clip for supporting eyeglasses having two eyepiece rims interconnected by a central bridge and including temples hingedly connected to said rims on a generally vertical support post, said display clip comprising a generally rectangular block of resilient synthetic plastic material including a central section having a generally vertically oriented first channel formed therethrough, said first channel being open on one side and shaped and sized to conformally grip said support post when forced thereonto by resilient expansion of the open side of said channel; and second and third horizontal channels formed into the upper surface of said block and extending from either side of said first channel to the ends of said block, said second and third channels being in substantial alignment with the center of the post gripping portion of said first channel whereby eyeglasses are attractively supported for display by inserting the lower edges of the eyepiece rims into said horizontal channels and extending the temples beyond said support post such that the bridge rests against said support post to support said eyeglasses in said display clip.

6. An eyeglass display clip as claimed in claim 5 wherein said first channel and support post are formed to permit said display clip to be positioned into a plurality of angular positions on said support post whereby eyeglasses supported on said clip may be displayed in any one of said plurality of positions.

7. An eyeglass display clip as claimed in claim 6 wherein said first channel and said support post are circular in cross-section.

8. An eyeglass display clip as claimed in claim 7 wherein the opening of said first channel is flared to facilitate engagement with said support post.

9. Eyeglass display apparatus for supporting eyeglasses having two eyepiece rims interconnected by a central bridge and including temples hingedly connected to said rims comprising:

at least one generally vertically oriented support post; and a plurality of eyeglass display clips frictionally engaged to said support post for supporting a like plurality of eyeglasses, each of said display clips comprising:

a post engaging section including a first channel for conformally engaging said support post, said first channel being open on one side for resiliently receiving said post; and second and third channels integrally formed to said central post engaging section and extending therefrom on opposite sides of said first channel, said second and third channels being substantially aligned with the center of the post engaging portion of said first channel and open in an upward direction when said clip is engaged with said support post whereby eyeglasses are supported for attractive and complete visual display by inserting the lower edges of the eyepiece rims into said second and third channels with said temples extending beyond said support post such that the bridge of the eyeglasses rests against said support post to maintain the eyeglasses in an attractive display posture with one or both temples fully extended and, hence, clearly in view.

10. Eyeglass display apparatus as claimed in claim 9 wherein said first channel and support post are formed to permit said display clips to be positioned into a plurality of angular positions on said support post whereby eyeglasses supported on said clips may be displayed in any one of said plurality of positions.

11. Eyeglass display apparatus as claimed in claim 10 wherein said first channel and said support post are circular in cross-section.

12. Eyeglass display apparatus as claimed in claim 11 wherein the opening of said first channel is flared to facilitate engagement with said support post.

* * * * *